US010100641B2

(12) United States Patent
Chapman

(10) Patent No.: US 10,100,641 B2
(45) Date of Patent: Oct. 16, 2018

(54) ROTARY VANE ACTUATOR AND VANE ASSEMBLY

(71) Applicant: Kinetrol Limited, Farnham (GB)

(72) Inventor: Roger Charles Chapman, Farnham (GB)

(73) Assignee: KINETROL LIMITED, Farnham, Surrey (GB)

( * ) Notice: Subject to any disclaimer, the term of this patent is extended or adjusted under 35 U.S.C. 154(b) by 228 days.

(21) Appl. No.: 15/349,597

(22) Filed: Nov. 11, 2016

(65) Prior Publication Data

US 2018/0135623 A1 May 17, 2018

(51) Int. Cl.

| | |
|---|---|
| ***F01C 21/08*** | (2006.01) |
| ***F03C 4/00*** | (2006.01) |
| ***F04C 15/00*** | (2006.01) |

(52) U.S. Cl.

CPC ..... *F01C 21/0881* (2013.01); *F03C 4/00* (2013.01); *F04C 15/0015* (2013.01); *F04C 2240/20* (2013.01); *F05C 2251/00* (2013.01); *F05C 2253/14* (2013.01)

(58) Field of Classification Search

CPC ..... F15B 15/12; F01C 21/0881

See application file for complete search history.

(56) References Cited

U.S. PATENT DOCUMENTS

| | | | | |
|---|---|---|---|---|
| 1,777,143 A * | 9/1930 | Hueber | ..... | F15B 15/12 92/124 |
| 2,012,817 A * | 8/1935 | Horton | ..... | F15B 15/12 92/124 |
| 4,379,543 A * | 4/1983 | Reaves | ..... | F16K 31/12 251/59 |
| 6,289,787 B1 * | 9/2001 | Underwood | ..... | F15B 15/12 92/121 |
| 9,085,978 B2 * | 7/2015 | Chapman | ..... | F01C 9/002 |

* cited by examiner

*Primary Examiner* — Thomas E Lazo

(74) *Attorney, Agent, or Firm* — Stephen J. Weyer, Esq.; Stites & Harbison, PLLC

(57) ABSTRACT

A vane assembly for use in a rotary vane actuator, the vane assembly comprising: a rotatable vane having a first side and a second side; a vane axle connected to the rotatable vane for converting pressure exerted on the rotatable vane into rotational motion; a vane seal on the first side of the rotatable vane, the vane seal being for sealing the rotatable vane; and a side-plate on the first side of the rotatable vane, the side-plate clamping the vane seal in position; wherein the side-plate comprises: an outer part providing an outer surface of the side-plate, the outer part defining an internal volume; and an inner part filling or substantially filling the internal volume defined by the outer part, the inner part being distinct from the outer part.

22 Claims, 9 Drawing Sheets

PRIOR ART

PRIOR ART

PRIOR ART

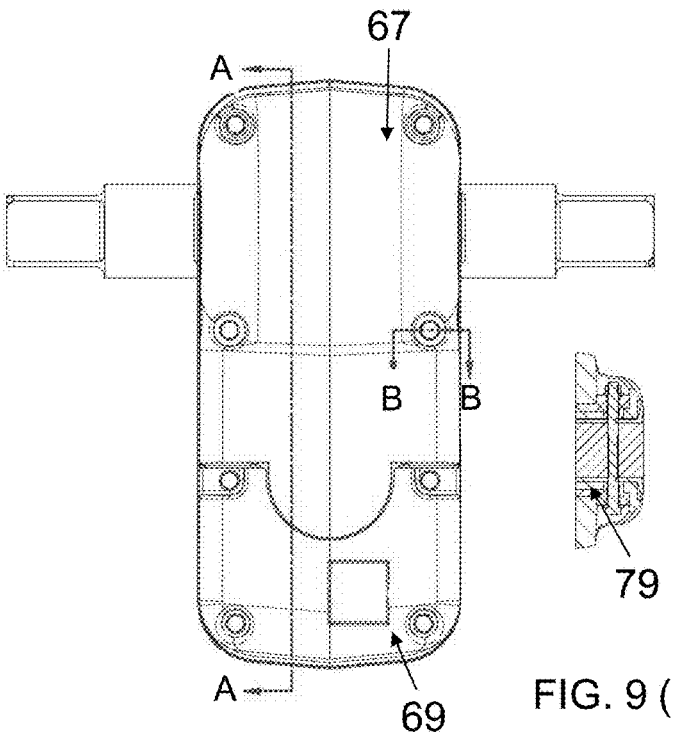
FIG. 9 (a)
FIG. 9 (b)
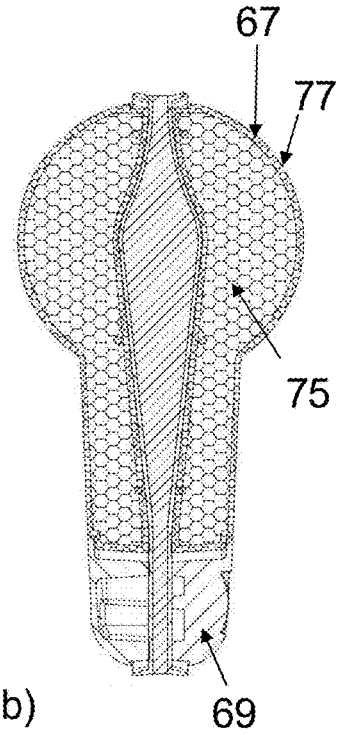
FIG. 9 (c)

ROTARY VANE ACTUATOR AND VANE ASSEMBLY

FIELD OF THE INVENTION

The present invention relates to rotary vane actuators, and to vane assemblies for use in rotary vane actuators.

BACKGROUND OF THE INVENTION

A typical rotary vane actuator has a housing providing a fixed volume cavity (an enclosed space). The cavity is divided into first and second chambers by a vane assembly. The vane assembly is rotatable within the cavity about a vane axle provided adjacent to an end of the vane assembly.

Pressurised fluid is separately provided to each of the first and second chambers by respective ports. In order to generate rotation of the vane assembly in a direction from the first chamber to the second chamber, the pressure of the pressurised fluid in the first chamber is increased by introducing additional pressurised fluid into the first chamber, and/or the pressure in the second chamber is reduced by removing some pressurised fluid from the second chamber. A pressure difference is therefore generated across the vane assembly between a higher pressure in the first chamber and a lower pressure in the second chamber. This pressure difference generates a torque on the vane assembly, resulting in rotational movement of the vane assembly in a direction away from the first chamber towards the second chamber.

As the vane assembly rotates, additional pressurised fluid continues to be introduced into the first chamber, and/or pressurised fluid continues to be removed from the second chamber, to maintain the pressure difference between the first and second chambers.

Rotation of the vane assembly in an opposite direction away from the second chamber towards the first chamber is achieved in an equivalent manner by providing a higher pressure in the second chamber than in the first chamber, by introducing additional pressurised fluid to the second chamber and/or by removing pressurised fluid from the first chamber.

Typically, a stop is provided in the housing to fix an extreme of a range of rotational motion of the vane assembly. For example, it is known to provide a bolt or screw that protrudes into the housing so that the vane assembly contacts a tip of the bolt or screw when the vane assembly is at an extreme rotational position, so that the vane assembly is prevented from rotating beyond that position. In practice, two such stops are normally provided, one in the first chamber and one in the second chamber, to delimit two extremes of the range of rotational motion of the vane assembly. The stop is typically adjustable, but this is not essential. For example, typically the stop is a threaded bolt or screw that extends into the cavity through a threaded hole in the housing, so that an extent to which a tip of the bolt or screw protrudes into the housing can be adjusted by rotating the bolt or screw relative to the housing.

Energy is fed into the actuator by the flow of pressurised fluid and converted into mechanical work in the form of rotation of the vane axle against a torque imposed on the vane axle by an external load.

The construction of the vane assembly is important to the efficiency of the actuator. In particular, it is important that the vane assembly provides a seal between the first and second chambers so that the energy from the input flow of pressurised fluid is efficiently converted into rotational work, rather than being wasted by leaking between the first and second chambers around the vane assembly.

The vane assembly must also be able to withstand loads applied to the vane assembly by the pressurised fluid, and loads applied to the vane assembly when the vane assembly contacts a stop and is pressed against the stop.

Different constructions for the vane assembly are known. A known construction will now be discussed with reference to FIGS. 1 to 4. FIG. 1 is an exploded view of a known vane assembly 1, FIG. 2(*a*) is a side view of the known vane assembly 1, FIG. 2(*b*) is a cross-sectional view along the line A-A of FIG. 2(*a*) showing the internal structure of the known vane assembly 1, FIG. 3 is an exploded view of a rotary vane actuator including the known vane assembly 1, and FIG. 4 is a cross-sectional view of a rotary vane actuator including the known vane assembly 1.

As shown in FIG. 1, the known vane assembly 1 comprises a vane 3 that has a shaft 5 provided adjacent to an end of the vane 3, so that the vane 3 and shaft 5 are rotatable together about a central axis of the shaft 5. The vane 3 is generally in the form of a rigid paddle, and is made of rigid material, typically steel.

A first vane seal 7 is provided on a first surface of the vane 3. The first vane seal 7 is made of a flexible material such as polyurethane. The first vane seal 7 has a seal lip 9 around the outer periphery thereof. When the known vane assembly 1 is positioned in an appropriate housing (discussed below with reference to FIGS. 3 and 4), so that the vane assembly 1 separates the housing into first and second chambers, the seal lip 9 of the first vane seal 7 contacts an inner surface of the housing to form a seal between the vane assembly 1 and the housing that prevents, or substantially prevents, the leaking of pressurised fluid from the first chamber to the second chamber.

A first seal expander 11, made from a springy material such as steel, is also provided. The first seal expander 11 is shaped to contact and apply force to an inner surface of the seal lip 9 of the seal 7, to keep the seal lip 9 in contact with an inner surface of the housing so as to maintain a good seal. The first seal expander 11 overcomes a problem of creep under stress of the seal material which may otherwise occur. However, the first seal expander 11 is not essential. For example, the first seal expander 11 can be omitted where the first vane seal 7 is made of a creep resistant material.

The first vane seal 7 and first seal expander 11 are clamped in position on the first side of the vane 3 by a first side-plate 13.

The first side-plate 13 is made of plastic, and is manufactured by a suitable moulding or casting process, such as injection moulding. The first side-plate 13 is substantially hollow and has an internal void 15. The internal void 15 is exposed on an inner surface of the first side-plate 13, so that the internal void 15 is accessible from the inner surface of the first side-plate 13.

In an alternative known construction the first side-plate 13 is instead formed from sheet metal which is cut to the required shape and formed by bending the cut sheet into the desired profile for the first side-plate. However, this alternative known construction is typically more wasteful in terms of compressed fluid usage during operation of the rotary vane actuator.

The first side-plate 13 has sufficient strength to withstand pressures applied to the first side-plate 13 by pressurised fluid when the known vane assembly 1 is used in a rotary vane actuator, and to withstand pressures applied to the first side-plate 13 when the first side-plate 13 contacts and is pressed against a stop in a cavity of a housing of the rotary vane actuator. To increase the strength of the first side-plate 15, strengthening ribs are provided in the internal void 15 of the first side-plate 13.

The first side-plate 13 is moulded to a have a shape for taking up more volume of a cavity of a housing of a rotary vane actuator than a simple flat metal side-plate. Specifically, as shown in FIGS. 1 to 3, the first side-plate includes a protruding curved portion, or bulbous portion, 14 proximal to the position of the shaft 5. In the curved, or bulbous, portion 14 an outer surface of the first side-plate 13 is curved outwards, so that the overall volume of the first side-plate 13 is increased relative to a simple flat metal side-plate. In particular, the curved, or bulbous, portion 14 occupies space when the vane assembly is at an extreme of its range of rotational motion that would otherwise be dead/empty space.

Thus, the volume of the cavity in the housing occupied by the vane assembly 1 is increased relative to a simple flat metal side-plate. This has an advantage of reducing a volume of pressurised fluid that needs to be supplied to the first or second chamber of the cavity to cause rotational movement of the vane assembly 1, because the empty volume of the cavity is reduced.

A corresponding arrangement of a second vane seal 17, second seal expander 19 and second side-plate 21 is provided on an opposite second side of the vane 3. The arrangement on the second side of the vane 3 is a mirror image of the arrangement on the first side of the vane 3, and the descriptions given above of the first vane seal 7, first seal expander 11 and first side-plate 21 also apply to the corresponding second vane seal 17, second seal expander 19 and second side-plate 21.

The vane assembly 1 is held together using threaded screws 23 and corresponding nuts 25, so that the vane seals 7, 17 and seal expanders 11, 19 are sandwiched between the side-plates 13, 21 and the vane 3 and clamped in position. Specifically, the threaded screws 23 extend through the vane assembly 1 from one side of the vane assembly 1 to the other side through corresponding holes formed in the side-plates 13, 21, seal expanders 11, 19, vane seals 7, 17 and vane 3, and the corresponding nuts 25 are connected to the ends of the threaded screws 23 and tightened so that the side-plates 13, 21 clamp the vane seals 7, 17 and seal expanders 11, 19 in position against the vane 3. Alternatively, it is also known to use a combination of studs or bolts and nuts to hold the vane assembly 1 together.

FIG. 3 shows an exploded view of a known rotary vane actuator 27 including the known vane assembly 1. As shown in FIG. 3, the rotary vane actuator 27 has a housing comprising a first shell part 29 and a second shell part 31. When the first shell part 29 and second shell part 31 are joined together, an enclosed cavity 33 is formed between them.

As shown in FIG. 3, the vane assembly 1 is positioned in the enclosed cavity 33 between the first and second shell parts 29, 31. The second shell part 31 has an opening 35 at an upper part thereof for receiving the shaft 5 of the vane assembly 1, so that the vane assembly 1 is rotatably mounted in the cavity 33.

The vane assembly 1 therefore separates the cavity 33 into first and second chambers, and the vane seals 7, 17 form a pneumatic seal between the first and second chambers that prevents, or substantially prevents, fluid from passing between the first and second chambers around the vane assembly 1.

As shown in FIG. 3, at least one stop 34, in the form of a threaded screw that extends through the housing into the cavity 33, is provided to set an extreme of the rotation of the vane assembly within the cavity 33. In practice, two such stops may be provided, one on each side of the cavity 33 to set two opposite extremes of the rotation of the vane assembly. Typically the stops will be adjustable, so that an extent to which the stop extends into the cavity can be adjusted, for example by rotating the stop, e.g. where the stop is a threaded screw.

FIG. 4 is a schematic illustration of the known vane assembly 1 separating a cavity of a housing 36 of a rotary vane actuator into first and second chambers 37 and 38, as discussed above.

SUMMARY OF THE INVENTION

The present inventor has realised that the known vane assembly 1 illustrated in FIGS. 1 to 4 can be improved.

Specifically, the present inventor has realised that it is advantageous to provide a vane assembly that occupies a larger volume of space than that occupied by a vane assembly having a simple flat metal side-plate, that has sufficient strength to withstand pressures applied to the vane assembly during operation of a rotary vane actuator, and that has a low cost of manufacture.

In the known vane assembly 1 the side-plate is made of plastic by injection moulding. In such injection moulding it is necessary to make the side-plate relatively thin, to prevent post mould distortion and other undesirable shrinkage effects, and to minimise cost, whilst allowing efficient moulding processes.

Therefore, in order to achieve a volume-filling shape of the side-plate as illustrated in FIGS. 1 to 4, it is necessary to manufacture the side-plate in the form of a substantially hollow shape with an internal void 15, for example as a substantially hollow shell.

The present inventor has realised that this internal void 15 of the known vane assembly 1 represents an empty, dead, space of the known vane assembly 1 that must be filled with pressurised fluid during operation. Thus, a volume of fluid that must be introduced into a cavity in which the vane assembly is positioned in order to cause rotation of the vane assembly is increased. Thus, the fluid usage of a rotary vane actuator including the vane assembly is increased.

The present inventor has realised that it is not feasible in terms of cost and manufacturing to provide a solid side-plate made in one piece from a single continuous material that meets the requirements discussed above. For example, a large solid metal side-plate would be expensive and suffer from the same moulding/casting problems of shrinkage and distortion of other lower strength materials. Furthermore, as discussed above, when producing a plastic side-plate with an external shape as illustrated in FIGS. 1 to 4, it is necessary to mould the side plate as a hollow shape with thin walls in order to prevent mould distortion and other undesirable shrinkage effects whilst allowing efficient moulding processes.

Instead, the present inventor has realised that the advantages of providing a vane assembly that occupies a larger volume of space than a vane assembly having a simple flat metal side-plate would do, that has sufficient strength to withstand pressures applied to the vane assembly during operation of a rotary vane actuator, and that has a low cost of manufacture, can be achieved by providing a "two-part" or "two-portion" side plate, in which the side-plate includes a first part or portion having sufficient strength to withstand pressures applied to the vane assembly during operation of a rotary vane actuator, and a second part or portion that is at least partly enclosed by the first part or section and that provides low-cost volume filling.

Therefore, at its most general the present invention provides a vane assembly including a side plate that has a first part or portion providing an external surface of the side-plate, and a second part or portion that is at least partly enclosed by the first part or portion.

According to a first aspect of the present invention there is provided a rotary vane actuator having a housing and a vane assembly, wherein:

the housing has a cavity accommodating the vane assembly, the vane assembly dividing the cavity into a first chamber and a second chamber; and the vane assembly comprises:

a rotatable vane having a first side and a second side;

a vane axle projecting from the housing and being connected to the rotatable vane to convert pressure exerted on the rotatable vane into rotational motion;

a vane seal on the first side of the rotatable vane, the vane seal providing a seal between the rotatable vane and the housing; and a side-plate on the first side of the rotatable vane, the side-plate clamping the vane seal in position;

wherein the side-plate comprises:

an outer part providing an outer surface of the side-plate, the outer part defining an internal volume; and an inner part filling or substantially filling the internal volume defined by the outer part, the inner part being distinct from the outer part.

The term "part" may instead be replaced with the term "section" or "region" or "portion" or "area".

Thus, in the first aspect of the present invention the side-plate has a two-part or two-portion construction, in which a first part or portion (the outer part) provides an external surface of the side-plate, and a second part or portion (the inner part) fills or substantially fills an internal volume defined by the first part or portion.

The term "outer part" may mean a part of the side-plate that is exposed at an outer surface of the vane assembly when the vane assembly is constructed. An outer surface may mean a surface that comes into contact with pressurised fluid during operation of the rotary vane actuator. "outer" may mean "outermost".

The term "inner part" may mean a part of the side-plate that is not exposed at an outer surface of the vane assembly when the vane assembly is constructed.

The inner part is distinct from the outer part. Thus, the inner part and the outer part are not formed from a single continuous material. The term distinct means that the inner part differs from the outer part in one or more material properties thereof, for example in terms of the material, the density, the structure, or some other material property. For example, the term "distinct" means that there is a (discontinuous) boundary or transition between the inner part and the outer part.

The outer part may provide all, or substantially all, external surfaces of the side-plate. Alternatively, the outer part may provide only part of, or one of, all external surfaces of the side-plate.

The outer part defines the internal volume by surrounding or by partly surrounding the internal volume. For example, the outer part may fully enclose the internal volume, so that the internal volume is completely surrounded by the outer part. Alternatively, the outer part may partly enclose the internal volume, so that the internal volume is open or exposed at a surface of the side-plate or outer part. The internal volume may be substantially fully enclosed by the outer part and by other parts of the vane assembly, for example the vane, when the vane assembly is assembled.

The internal volume defined by the outer part may be a space in the outer part. In other words, the outer part may have a void or gap that provides the internal volume. Thus, the inner part fills or substantially fills the space in the outer part, so that the resulting side-plate is substantially solid, but has a two-part construction, as discussed above.

The outer part may be in the form of a shell, wall or boundary layer that surrounds or partly surrounds the internal volume. For example the outer part may be a hollow shell, or a part or a section of a hollow shell. Thus, the internal volume may be a hollow space of the hollow shell.

The inner part may be a separate insert positioned in the space in the outer part. In other words, the separate insert may be manufactured separately to the outer part and then positioned in the space in the outer part. For example, the separate insert may be separately formed, e.g. moulded, to have the same shape as the internal volume of the outer part, so that the separate insert fills or substantially fills the internal volume of the outer part.

Alternatively, the inner part may be moulded in situ in the space in the outer part. Thus, the inner part can easily be made to fill or to substantially fill the internal volume of the outer part.

Where the internal volume of the outer part is a space or void in the outer part, the internal volume is accessibly, e.g. exposed or open, at a side surface of the outer part, so that the inner part can be positioned in the internal volume. Typically this side surface is the side surface that faces towards the vane when the vane assembly is assembled.

The outer part and the inner part may be made of different materials. In other words, the outer part may be made of a first material and the inner part may be made of a second material that is different to the first material.

The materials for the outer and inner parts can therefore be chosen to meet different requirements in terms of material properties (such as strength) and cost. For example, the material of the outer part can be chosen to have sufficient mechanical strength to withstand pressures applied to the vane assembly during operation of a rotary vane actuator, for example pressure from a pressurised fluid. Since the material of the inner part does not necessarily need to have the same mechanical strength, a cheaper and/or lighter material with a lower mechanical strength can be used instead for the inner part. Thus, the side-plate will achieve the same volume filling requirements and mechanical strength requirements as e.g. a solid side-plate made of continuous material, but may be considerably cheaper to manufacture. The material of the inner part may also improve the impact energy absorbing characteristics of the vane assembly.

The inner part may have a lower density than the outer part. Thus, the side-plate and therefore the vane assembly may be lighter than if the whole side-plate was made of the first material. This may improve the efficiency of operation of a rotary vane actuator including the vane assembly.

The outer part may be manufactured using a moulding or casting process. For example, the outer part may be moulded, e.g. injection moulded. For example, the outer part may be the same or substantially the same as the side-plate of the known vane assembly 1 illustrated in FIGS. 1 to 4, and may have any of the features of the side-plate of the known vane assembly 1 discussed above.

The outer part may be made of plastic.

Alternatively, the outer part may be made from a metal, for example a light metal such as aluminium, which is moulded or shaped.

The inner part may also be manufactured using a moulding or casting process, and may be made of plastic. In that case, typically the inner part is made of a cheaper and/or lighter plastic than the material of the outer part, typically with a lower mechanical strength. This reduces the overall manufacturing cost of the vane assembly.

In other embodiments of the present invention the outer part and the inner part may be made of the same material. In other words, the outer part and the inner part may have the same chemical composition and/or the same components/ingredients.

However, the inner and outer parts may still be made separately. Alternatively, the inner and outer parts may be made at the same time.

In this case, the inner part may be distinct from the outer part because a structure of the material in the outer part is different to a structure of the material in the inner part.

The structure of the material of the outer part is chosen to provide a higher mechanical strength than the structure of the material of the inner part, so that the vane assembly is able to withstand pressures and/or energy of impact applied during operation of a rotary vane actuator. The structure of the material in the inner part is chosen to reduce cost and/or weight relative to the structure of the material in the outer part, and may also be chosen to have improved energy absorption, so that the vane assembly is better able to absorb impact energy when the vane assembly contacts a stop of the rotary vane actuator.

For example, a density of the material in the outer part may be different to a density of the material in the inner part. Typically the density of the material in the outer part will be higher than the density of the material in the inner part, so that the material in the outer part has a higher mechanical strength, and so that cost and/or weight of the inner part is reduced.

The inner part may be made of a foamed material. For example, the inner part may be made from a material that is foamed in a liquid state and then solidified to form a porous solid foam structure. This may provide a low cost and/or low density material. For example, the inner part may be made of polyurethane foam.

The foamed material may be formed inside the internal volume of the outer part, which may be formed in advance e.g. by moulding or casting.

The outer part may be made of a higher density skin of the same material. Thus, the outer part is made of the same material, but has a higher density and therefore mechanical strength. For example, the outer part may be non-porous, or substantially non-porous. A higher density skin of the same material may be achieved by increasing an amount of foamed material provided to a mould to an amount greater than is necessary to form a continuous solid foam article using the mould. In this manner, a non-porous or substantially non-porous outer layer having an increased density and mechanical strength relative to the solid foamed interior can be formed. The outer layer therefore forms the outer part of the present invention, and the solid foamed interior therefore forms the inner part of the present invention.

Where the side plate is made of foamed material, additional inserts made of stronger material may be added to the side plate in locations where fixing screws or bolts are positioned, in order to give higher strength locally under the fixing screws. For example, such inserts may be embedded in the foam material.

The inner part may occupy a larger volume of the side-plate than the outer part. Thus, the inner part provides significant low-cost volume filling.

For example, a volume of the outer part may be less than 50% of a volume of the inner part. Alternatively, the volume of the outer part may be less than 40%, 30%, 20% or 10% of the volume of the inner part. Thus, the bulk of the volume of the side-plate may be made up of the inner part.

The side plate may comprise a further part providing a further outer surface of the side-plate for contacting a stop, the further part being distinct from the outer part. A part of the side-plate that contacts the stop may experience particularly large forces. Therefore, the strength of the side plate can be improved by providing a stronger further part that provides a further outer surface of the side-plate for contacting a stop. For example, the further part may be a moulded part, for example a plastic part made by injection moulding. Alternatively, in other embodiments the outer part itself may have sufficient mechanical strength to withstand the impact of contacting the stop, and therefore in these embodiments the further part is not necessary.

The further part may form an end part of the side-plate.

Typically, the further part is made separately from the outer part and is then connected to the outer part, for example using bolts or screws.

The further part may be made by moulding, for example injection moulding, and may be made of plastic or metal, for example.

The vane assembly may further comprise a seal expander positioned between the vane seal and the side-plate, wherein the seal expander is configured to contact and apply outward force to the vane seal to maintain the seal between the rotatable vane and the housing. Typically the seal expander will be made of springy material, such as steel. The seal expander may overcome a problem of creep under stress of the seal material which may otherwise occur. However, the seal expander is not essential to the present invention, and can be omitted, for example where the vane seal comprises a material that has sufficient creep resistance.

The side-plate may form at least 25% by volume of the vane assembly. Thus, the side-plate may fulfil a significant volume-filling role.

The vane assembly may occupy at least 20% by volume of the cavity of the housing.

In a rotary vane actuator, there is typically a dead volume, e.g. in a region of the cavity in the housing which is not swept/displaced by the vane assembly, or internal to the vane assembly where the vane assembly is hollow. This is typically because the shape of the vane assembly, for example the shape of the side plate, does not exactly match the shape of the side walls of the housing.

The fluid usage of the rotary vane actuator can be reduced, and the efficiency of the rotary vane actuator therefore increased, by reducing the proportion of this dead volume to the total volume of the cavity, or to the swept (displaced) volume of the cavity.

Therefore, in the present invention the side plate may be configured, i.e. have a predetermined shape and size, so that the dead volume of the cavity in the housing is less than 20% of the total volume of the housing, or less than 15% of the total volume of the housing, or less than 10% of the total volume of the housing. This reduces the fluid usage of the rotary vane actuator, and therefore improves the efficiency of the rotary vane actuator.

The vane assembly may further comprise: a second vane seal on the second side of the rotatable vane, the second vane seal providing a seal between the rotatable vane and the housing; and a second side-plate on the second side of the rotatable vane, the second side-plate clamping the second vane seal in position. Providing a second vane seal on an opposite side of the vane may improve the seal formed between the vane seal and the housing.

In this case, the second side-plate may comprise: a second outer part providing an outer surface of the second side-plate, the second outer part defining an internal volume; and a second inner part filling or substantially filling the internal volume defined by the second outer part, the second inner part being distinct from the second outer part.

The second side-plate may have any of the features of the first side-plate discussed above.

According to a second aspect of the present invention there is provided a vane assembly for use in a rotary vane actuator, the vane assembly comprising:

a rotatable vane having a first side and a second side;

a vane axle connected to the rotatable vane for converting pressure exerted on the rotatable vane into rotational motion;

a vane seal on the first side of the rotatable vane, the vane seal being for sealing the rotatable vane; and a side-plate on the first side of the rotatable vane, the side-plate clamping the vane seal in position;

wherein the side-plate comprises:

an outer part providing an outer surface of the side-plate, the outer part defining an internal volume; and an inner part filling or substantially filling the internal volume defined by the outer part, the inner part being distinct from the outer part.

The vane assembly according to the second aspect of the present invention may have any of the features of the vane assembly of the first aspect of the present invention discussed above.

There may also be provided a method of manufacturing a side-plate for use in a vane assembly of a rotary vane actuator, comprising: forming an outer part providing an outer surface of the side-plate, the outer part defining an internal volume; and forming an inner part filling or substantially filling the internal volume defined by the outer part, the inner part being distinct from the outer part.

The rotary vane actuator of the present invention is typically a pneumatic actuator in which fluid is used to rotate the vane, and the fluid is typically gas, e.g. air.

BRIEF DESCRIPTION OF THE DRAWINGS

Embodiments of the present invention will now be discussed, by way of example only, with reference to the accompanying Figures, in which:

FIG. 2(*b*) is a cross-sectional view along the line A-A of FIG. 2(*a*);

FIG. 6(*b*) is a cross-sectional view along the line A-A of FIG. 6(*a*);

FIG. 8(*b*) is a cross-sectional view along the line A-A of FIG. 8(*a*) according a third embodiment of the present invention;

FIG. 9(*a*) is a side view of the vane assembly of FIG. 7;

FIG. 9(*b*) is a cross-sectional view along the line B-B of FIG. 9(*a*) according to a fourth embodiment of the present invention;

FIG. 9(*c*) is a cross-sectional view along the line C-C of FIG. 9(*a*) according to the fourth embodiment of the present invention.

DETAILED DESCRIPTION OF THE PREFERRED EMBODIMENTS AND FURTHER OPTIONAL FEATURES OF THE INVENTION

Figure 4:
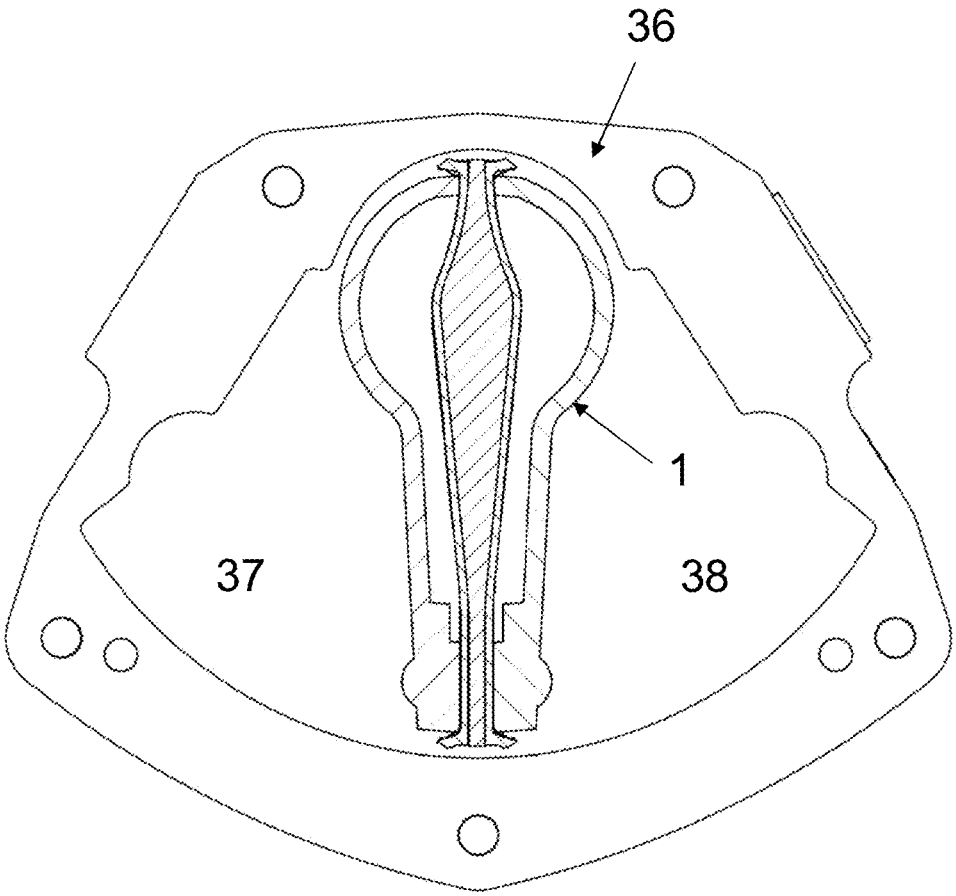
FIG. 4 is a cross-sectional view of a rotary vane actuator including the known vane assembly of FIG. 1.
Figure 5:
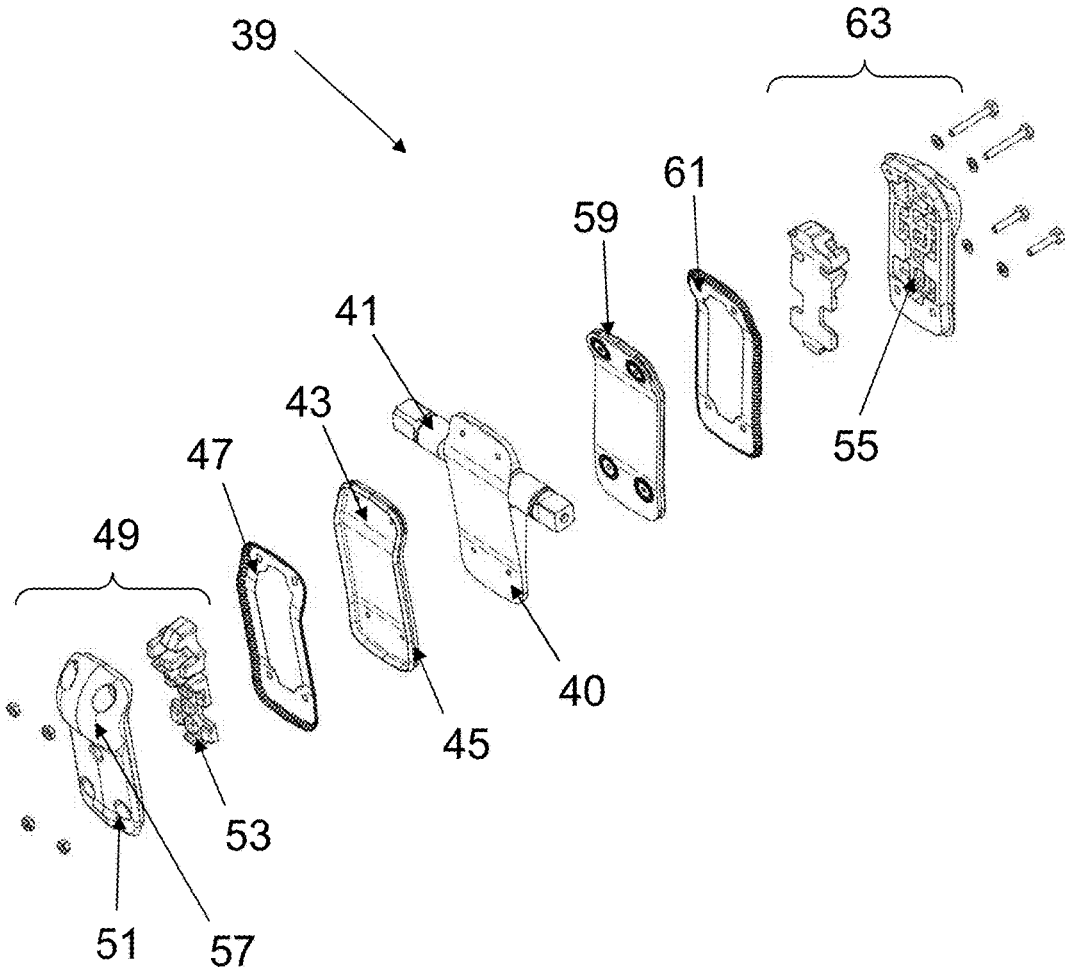
FIG. 5 is an exploded view of a vane assembly according to a first embodiment of the present invention.
Figure 6:
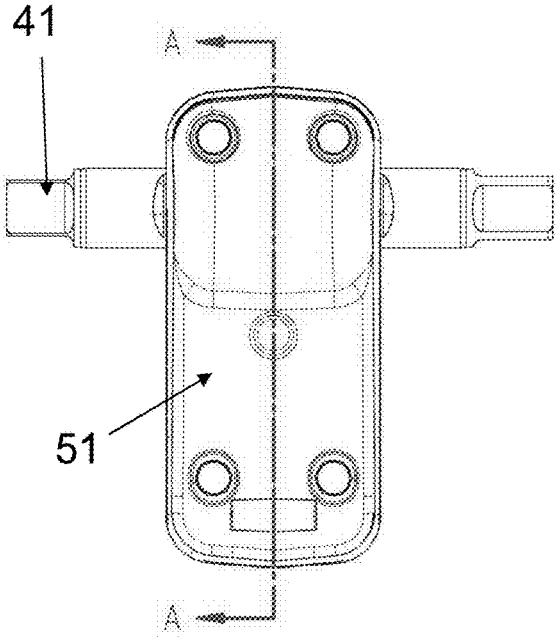
FIG. 6(*a*) is a side view of the vane assembly of FIG. 1.
Figure 6:
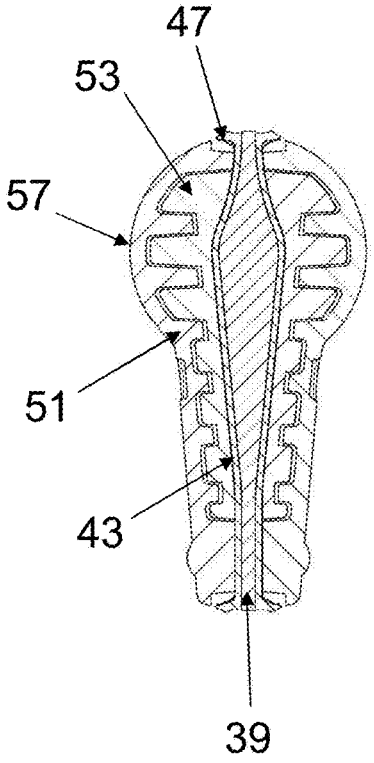

A vane assembly 39 according to a first embodiment of the present invention is illustrated in FIGS. 5, 6(*a*) and 6(*b*). In this embodiment, the vane assembly 39 is a modified version of the known vane assembly 1 illustrated in FIGS. 1 to 4 and described above, and therefore may have any of the features of the known vane assembly 1 described above.

As shown in FIG. 5, the vane assembly 39 comprises a vane 40 that has a shaft 41 provided adjacent to an end of the vane 39 so that the vane 40 and shaft 41 are rotatable together about a central axis of the shaft 41. The vane 40 is generally in the form of a rigid paddle, and is made of rigid material.

Typically the vane 40 is made of steel in a cast form, which may be machined in some areas. However, this is not essential.

A first vane seal 43 is provided on a first surface of the vane 40. The first vane seal 43 is made of a flexible material such as polyurethane. The first vane seal 43 has a seal lip 45 around the outer periphery thereof. When the vane assembly 39 is positioned in an appropriate housing, so that the vane assembly 39 separates the housing into first and second cavities in a similar manner to the arrangement of FIG. 4, the seal lip 45 of the first vane seal 43 contacts an inner surface of the housing to form a seal between the vane assembly 39 and the housing that prevents, or substantially prevents, the leaking of pressurised fluid from the first chamber to the second chamber.

A first seal expander 47, made from a springy material such as steel, is also provided. The first seal expander 47 is shaped to contact and apply force to an inner surface of the seal lip 45 of the seal 43, to keep the seal lip 45 in contact with an inner surface of the housing so as to maintain a good seal. The first seal expander 47 overcomes a problem of creep under stress of the seal material which may otherwise occur. However, the first seal expander 47 is not essential and can be omitted, for example where the seal 43 is made of a material having sufficient creep resistance.

The first vane seal 43 and first seal expander 47 are clamped in position on the first side of the vane 3 by a first side-plate 49.

The first side-plate 49 has a two-part (or two-portion) construction including an outer part 51 and an inner part 53.

The outer part 51 is made of plastic, and is manufactured by injection moulding. However, in other embodiments the outer part 51 can be made differently, for example the outer part 51 may be moulded or formed of plastic or metal. The outer part 51 provides an external surface of the first side-plate 49 that comes into contact with pressurised fluid when the first side-plate 49 is used in a rotary vane actuator. The outer part 51 has sufficient strength to withstand pressures applied to the outer part 51 by pressurised fluid when the vane assembly 39 is used in a rotary vane actuator, and to withstand pressures applied to the outer part 51 when the first side-plate 49 contacts and is pressed against a stop in a cavity of a housing of the rotary vane actuator.

As shown in FIGS. 5 and 6(*b*), the outer part 51 is substantially hollow and has an internal void 55. The internal void 55 is exposed on an inner surface of the outer part 51, so that the internal void 55 is accessible from the inner surface of the outer part 51. The outer part 51 therefore is in the form of a hollow shell (or part of a hollow shell) having a hollow opening that is (fully) exposed or open at a surface of the hollow shell.

The inner part 53 is a separately formed insert or part that is shaped to correspond, or to substantially correspond, to the internal void 55 of the outer part 51.

The inner part 53 is typically moulded, and may be made from plastic.

As shown in the cross-sectional view of FIG. 6(*b*), when the vane assembly 39 is constructed the inner part 53 is inserted into the internal void 55 of the outer part 51 to fill, or substantially fill, the internal void 55 of the outer part 51.

The resulting first side-plate 49 is substantially solid but has a two-part form.

To increase the strength of the outer part 51, strengthening ribs may be provided in the internal void 55 of the outer part 51. In this case, the inner part 53 is shaped to accommodate and fit around the ribs.

The first side-plate 49 has a shape for taking up more volume of a cavity of a housing of a rotary vane actuator than a simple flat metal side-plate. Specifically, as shown in FIGS. 5 and 6(*b*), the outer part 51 of the first side-plate 49 includes a protruding curved portion, or bulbous portion, 57 proximal to the position of the shaft 41. In the curved, or bulbous, portion 57 an outer surface of the outer part 51 is curved outwards, so that the overall volume of the first side-plate 49 is increased relative to a simple flat metal side-plate.

In particular, the curved, or bulbous, portion 57 occupies space when the vane assembly 39 is at an extreme of its range of rotational motion that would otherwise be dead/empty space. Thus, the dead volume of the cavity is reduced, and in particular the ratio of the dead volume to the total volume or to the swept (displaced) volume is reduced.

Thus, the volume of the cavity in the housing occupied by the vane assembly 39 is increased relative to a simple flat metal side-plate. This has an advantage of reducing a volume of pressurised fluid that needs to be supplied to the first or second chamber of the cavity to cause rotational movement of the vane assembly 39, because the empty volume of the cavity is reduced.

Of course, the specific shape of the side-plate illustrated in FIG. 5 is not essential, and the side-plate may instead have a different shape.

The inner part 53 fills the internal void 55 of the outer part 51 so that the resulting first side-plate 49 is substantially solid without any internal voids. Thus, there is no empty, or dead, space inside the outer part 51 that becomes filled with pressurised fluid during operation of the rotary vane actuator. This reduces the amount of pressurised fluid that is needed to cause the vane assembly 39 to rotate, and therefore increases the efficiency of the rotary vane actuator.

The inner part 53 may be made of a same material as the outer part 51, or a different material. In practice, the inner part 53 is made from a lower cost material than the outer part 51, so typically the inner part 53 will have a lower mechanical strength and/or a lower density. The inner part 53 therefore provides low cost volume filling.

A corresponding arrangement of a second vane seal 59, second seal expander 61 and second side-plate 63 is provided on an opposite second side of the vane 40. The arrangement on the second side of the vane 40 is a mirror image of the arrangement on the first side of the vane 40, and the descriptions given above of the first vane seal 43, first seal expander 47 and first side-plate 49 also apply to the corresponding second vane seal 59, second seal expander 61 and second side-plate 63. However, it is not essential to have this corresponding arrangement on the second side of the vane.

Figure 1:
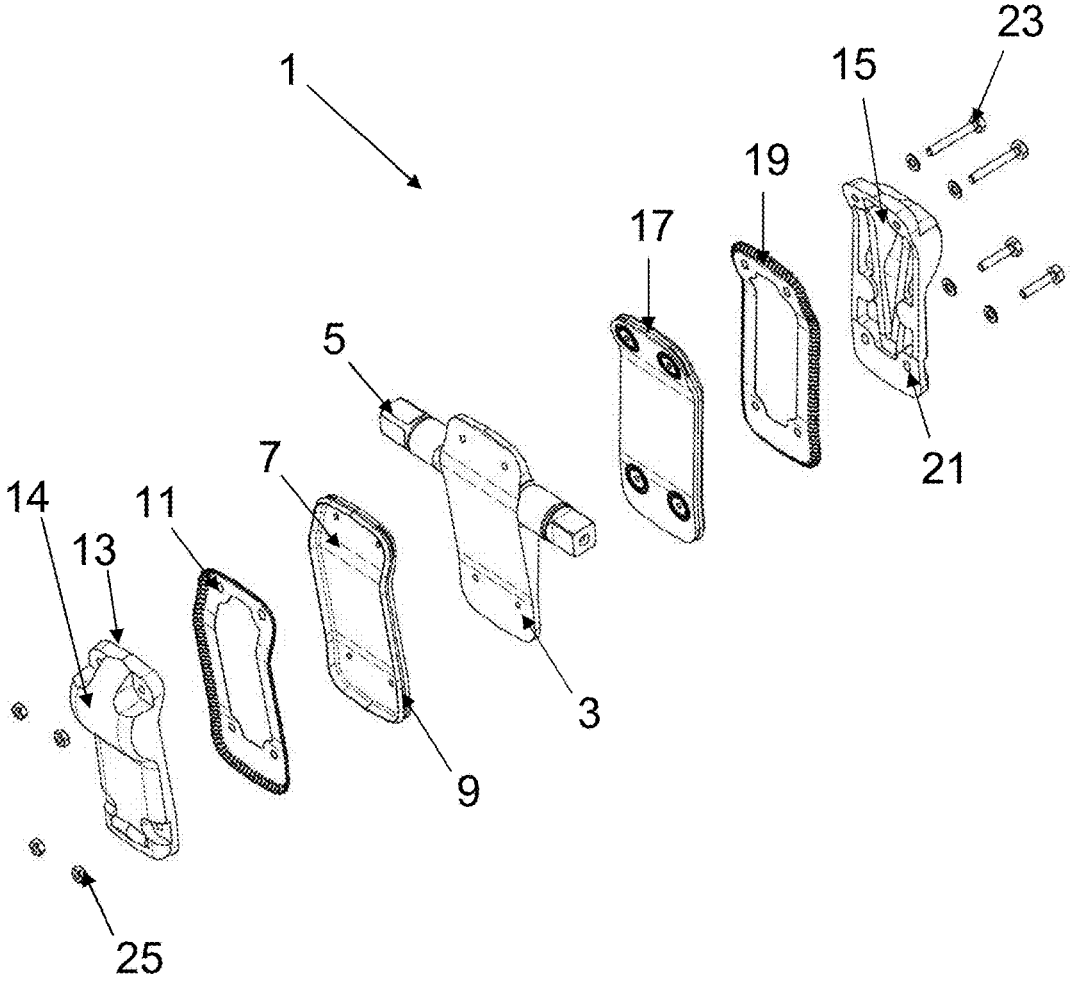
FIG. 1 is an exploded view of a known vane assembly.
Figure 2:
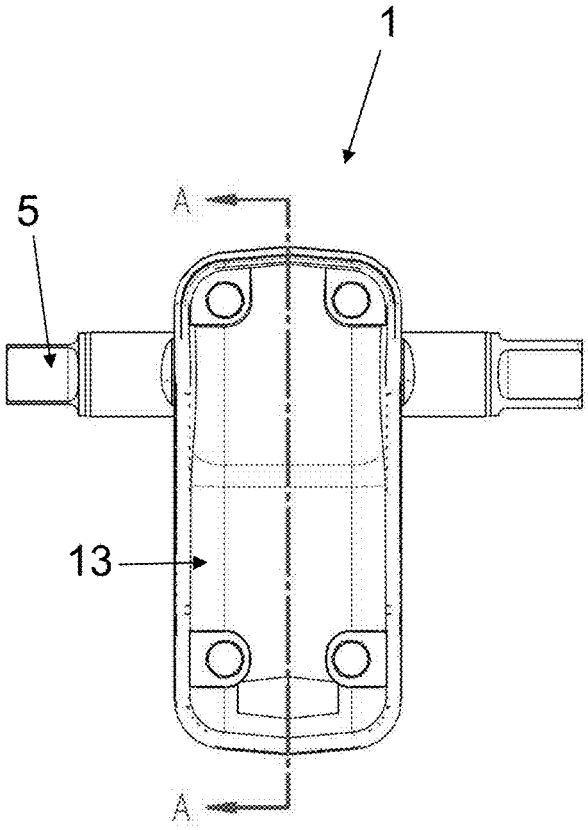
FIG. 2(*a*) is a side view of the known vane assembly of FIG. 1.
Figure 2:
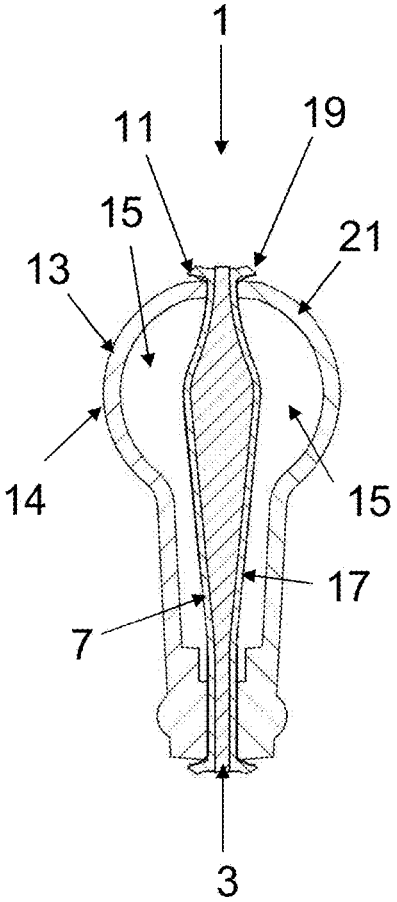

As with the known vane assembly 1 shown in FIG. 1, the vane assembly 39 is held together using threaded screws and nuts. The parts are the same as in FIG. 1, and description thereof is not repeated for conciseness. Of course, other ways of holding the vane assembly together may be used instead, for example by providing studs or bolts and corresponding nuts.

In the first embodiment, the inner part 53 is formed separately as a separate part and inserted into the internal void 55 of the outer part 51 to produce the first side-plate 49. In an alternative embodiment, the inner part 53 is instead moulded in-situ inside the outer part 51 to form the first side-plate 53, for example by pouring liquid material into the internal void 55 of the outer part 51.

Various different materials can be used for the inner part 53 and outer part 51 in the first embodiment, and the present invention is not limited to the materials being plastic, or to the parts 51, 53 being formed by moulding. For example, the outer part 51 could alternatively me made of metal. Instead, it is only important that the outer part 53 has sufficient mechanical strength to withstand pressures applied to the side-plate during operation of the rotary vane actuator. The inner part 53 can have a lower mechanical strength, and therefore is typically made of a cheaper material that is weaker and lower density, to provide low-cost volume filling.

As mentioned above, the outer part 51 of this embodiment includes strengthening ribs to increase the strength of the outer part 51. However, it is not essential for these strengthening ribs to be provided, and instead the outer part 51 itself may have sufficient strength.

Figure 7:
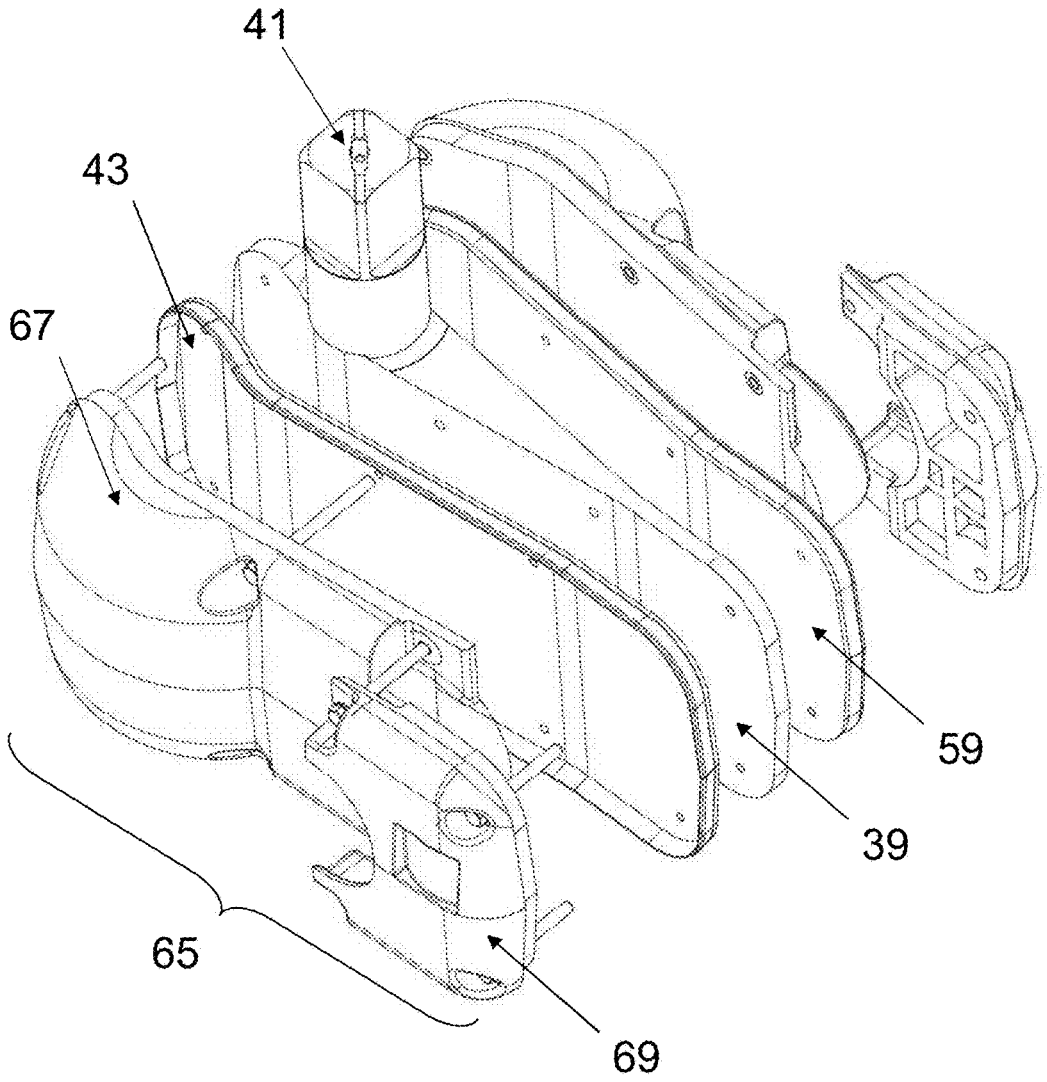
FIG. 7 is a partially exploded view of a vane assembly according to a second embodiment of the present invention.

A second embodiment of the present invention is shown in FIG. 7.

Some features which are the same as the first embodiment are shown with the same reference signs and description thereof is not repeated for conciseness.

The second embodiment differs from the first embodiment in terms of the structure of the side-plate. In the second embodiment, the side-plate 65 comprises two different parts that each provide external surfaces of the side-plate 65.

Specifically, the side-plate 65 comprises a main body part 67 and an end part 69. The end part 69 is positioned adjacent to the main body part 67 at an end of the side plate 65 opposite to the end adjacent to the shaft. A structure of the main body part 67 may be the same, or substantially the same, as the structure of the first side-plate 49 of the first embodiment discussed above. Alternatively, a structure of the main body part 67 may be as described in the embodiments discussed below.

The end part 69 provides an external surface of the side-plate 65 that will contact a stop in the cavity of the rotary vane actuator. In practice, the part of the side-plate that contacts the stop will experience the greatest pressure, and therefore needs to be the strongest part of the vane assembly. Therefore, an end part 69 having a greater mechanical strength than the main body part 67 is provided at the end of the side-plate 65 to contact the stop.

In this embodiment, the end part 69 is made of plastic and is manufactured by injection moulding. However, in other embodiments the end part 69 may be made of different materials, for example metal or plastic that is moulded or cast.

The end part 69 is connected to the main body part 57. In this embodiment, the end part 69 is connected to the main body part 57 by the same screws (or bolts, etc.) that connect the side plate 65 to the rest of the vane assembly.

Figure 8:
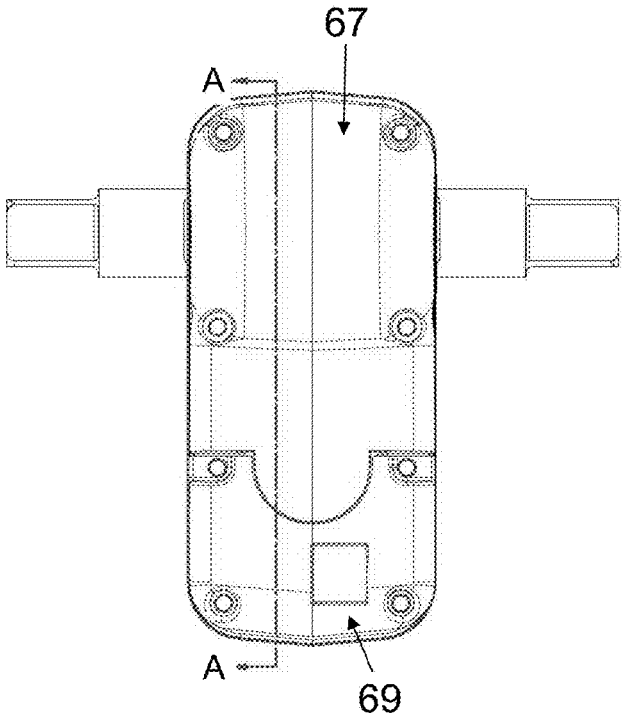
FIG. 8(*a*) is a side view of the vane assembly of FIG. 7.
Figure 8:
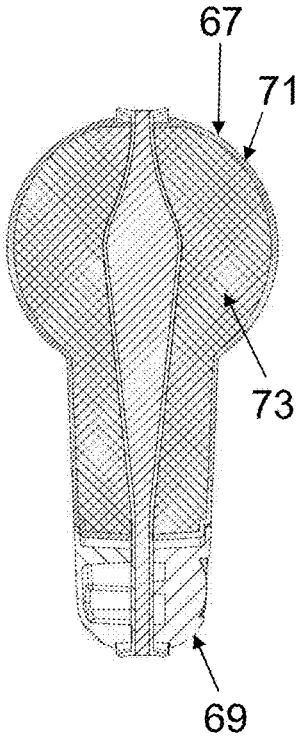

FIG. 8 shows the structure of main body part 67 of FIG. 7 in a third embodiment of the present invention. In this embodiment, the main body part 67 has an outer part in the form of a thin shell 71. The thin shell 71 is a hollow shape having a thin outer wall that partially surrounds an internal hollow space of the thin shell 71. The thin shell 71 is filled by an inner part 73 that comprises material that is moulded in-situ in the thin shell 71 to fill the hollow space in the thin shell 71.

The thin shell is made by moulding or casting, and may be made of plastic or metal.

Thus, the resulting main body part 67 is a solid main body part 67 having a thin shell 71 outer part and an inner part 73 filling the hollow space in the thin shell 71.

The material of the thin shell 71 is chosen to have a mechanical strength sufficient to withstand the pressures applied to the main body part 67 during operation of the rotary vane actuator.

The inner part 73 can have a lower mechanical strength and therefore is typically made of cheaper, lower density material. In one example, the inner part 73 may be made of a foamed material. In another embodiment, the inner part 73 may be made of a non-porous material, i.e. a non-foamed material.

As discussed above in relation to FIG. 7, the end part 69 adjacent to the main body part 67 contacts the stop. Thus, it is not necessary for the main body part 67 to be strong enough to withstand contacting the stop.

In the embodiment of FIG. 8, the end part 69 is made from moulded plastic. In other embodiments the end part may be made from other materials, for example metal or plastic that is moulded or case.

Of course, where the thin shell 71 has sufficient strength to withstand the pressures of contacting the stop itself, for example where the thin shell is made of metal or another material with sufficient mechanical strength, it is not essential for the end part 69 to be present, and instead the main body part 67 can form the whole, or substantially the whole, of the side plate.

FIG. 9 shows the structure of the main body part 67 of FIG. 7 in a fourth embodiment of the present invention.

In this embodiment, the main body part 67 comprises a solid foam inner part 75 completely surrounded by a higher density skin 77 of the same material.

The solid foam inner part 75 provides low-cost space filling.

The higher density skin 77 provides the necessary mechanical strength for the main body part 67 to be able to withstand the pressures applied to the main body part 67 during operation of the rotary vane actuator. For example, the higher density skin can be provided by over-filling a mould with foaming material, i.e. providing more foaming material than is necessary to provide a continuous foamed article, so that a non-porous, or substantially non-porous, skin or layer is formed at the surface of the moulded object.

As in the previous embodiment, a moulded plastic end part 69 is provided that has sufficient strength to contact the stop during operation of the rotary vane actuator.

As with the known vane assembly, the vane assembly of this embodiment is fixed together using screws and nuts. Alternatively, other connection methods such as studs or bolts and nuts may be used. In order to locally strengthen the material of the main body part 67 in the location of the studs or bolts of screws, where larger forces will be experienced, additional strengthening inserts 79 can be embedded in the main body part 67 to give higher strength locally under the fixing screws.

Of course, where the higher density skin 77 has sufficient strength to withstand the pressures of contacting the stop itself, it is not essential for the end part 69 to be present, and instead the main body part 67 can form the whole, or substantially the whole, of the side plate.

Figure 3:
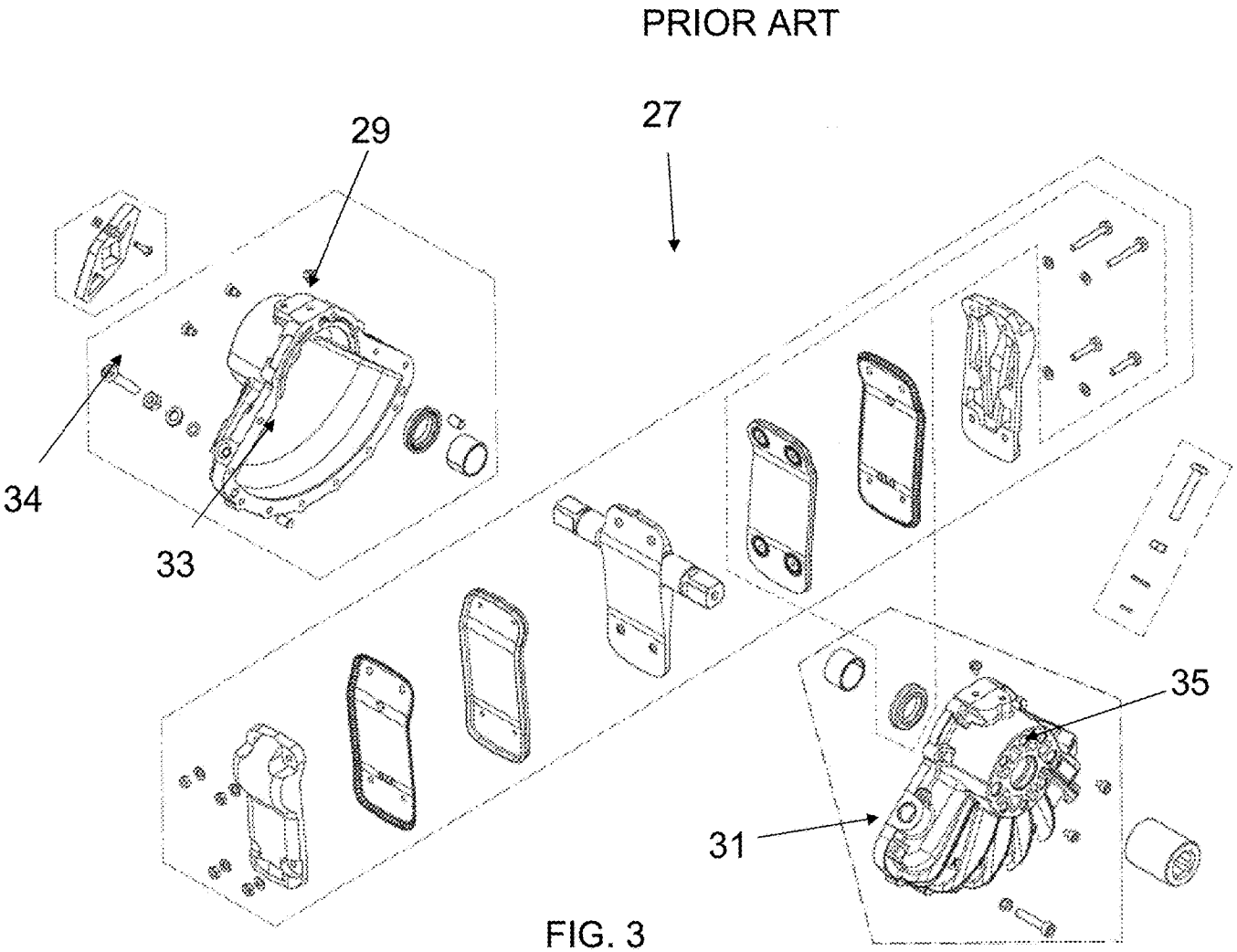
FIG. 3 is an exploded view of a rotary vane actuator including the known vane assembly of FIG. 1.

The vane assembly according to any of the embodiments of the present invention can be included in a rotary vane actuator as illustrated in FIGS. 3 and 4, so that the vane assembly is located in a cavity in a housing and separates the cavity into first and second chambers, as shown in FIG. 4.

Where plastic is used in the present invention, for example for the moulded plastic end part 69, the plastic may be a low cost plastic capable of withstanding the typical environmental conditions experienced in the rotary vane actuator, for example Nylon.

The invention claimed is:

1. A rotary vane actuator having a housing and a vane assembly, wherein:

the housing has a cavity accommodating the vane assembly, the vane assembly dividing the cavity into a first chamber and a second chamber; and the vane assembly comprises:

a rotatable vane having a first side and a second side;

a vane axle projecting from the housing and being connected to the rotatable vane to convert pressure exerted on the rotatable vane into rotational motion;

a vane seal on the first side of the rotatable vane, the vane seal providing a seal between the rotatable vane and the housing; and a side-plate on the first side of the rotatable vane, the side-plate clamping the vane seal in position;

wherein the side-plate comprises:

an outer part providing an outer surface of the side-plate, the outer part defining an internal volume; and an inner part filling or substantially filling the internal volume defined by the outer part, the inner part being distinct from the outer part.

2. The rotary vane actuator according to claim 1, wherein the internal volume defined by the outer part is a space in the outer part.

3. The rotary vane actuator according to claim 2, wherein the outer part is a hollow shell.

4. The rotary vane actuator according to claim 2, wherein the inner part is a separate insert positioned in the space in the outer part.

5. The rotary vane actuator according to claim 2, wherein the inner part is moulded in situ in the space in the outer part.

6. The rotary vane actuator according to claim 2, wherein the space in the outer part is exposed at an inner side of the side-plate.

7. The rotary vane actuator according to claim 1, wherein the outer part is made of a first material and the inner part is made of a second material that is different to the first material.

8. The rotary vane actuator according to claim 1, wherein the inner part has a lower mechanical strength and/or a lower density than the outer part.

9. The rotary vane actuator according to claim 1, wherein the outer part and the inner part are made of the same material.

10. The rotary vane actuator according to claim 9, wherein a structure of the material in the outer part is different to a structure of the material in the inner part.

11. The rotary vane actuator according to claim 9, wherein a density of the material in the outer part is different to a density of the material in the inner part.

12. The rotary vane actuator according to claim 1, wherein the inner part is made of a foamed material.

13. The rotary vane actuator according to claim 12, wherein the outer part is made of a higher density skin of the same material.

14. The rotary vane actuator according to claim 1, wherein the inner part occupies a larger volume of the side-plate than the outer part.

15. The rotary vane actuator according to claim 1, wherein the side-plate comprises a further part providing a further outer surface of the side-plate for contacting a stop, the further part being distinct from the outer part.

16. The rotary vane actuator according to claim 15, wherein the further part forms an end part of the side-plate.

17. The rotary vane actuator according to claim 1, wherein the vane assembly further comprises a seal expander positioned between the vane seal and the side-plate, wherein the seal expander is configured to contact and apply outward force to the vane seal to maintain the seal between the rotatable vane and the housing.

18. The rotary vane actuator according to claim 1, wherein the side-plate forms at least 25% by volume of the vane assembly.

19. The rotary vane actuator according to claim 1, wherein the vane assembly occupies at least 20% by volume of the cavity of the housing.

20. The rotary vane actuator according to claim 1, wherein the vane assembly further comprises:

a second vane seal on the second side of the rotatable vane, the second vane seal providing a seal between the rotatable vane and the housing; and a second side-plate on the second side of the rotatable vane, the second side-plate clamping the second vane seal in position.

21. The rotary vane actuator according to claim 20, wherein the second side-plate comprises:

a second outer part providing an outer surface of the second side-plate, the second outer part defining an internal volume; and a second inner part filling or substantially filling the internal volume defined by the second outer part, the second inner part being distinct from the second outer part.

22. A vane assembly for use in a rotary vane actuator, the vane assembly comprising:

a rotatable vane having a first side and a second side;

a vane axle connected to the rotatable vane for converting pressure exerted on the rotatable vane into rotational motion;

a vane seal on the first side of the rotatable vane, the vane seal being for sealing the rotatable vane; and a side-plate on the first side of the rotatable vane, the side-plate clamping the vane seal in position;

wherein the side-plate comprises:

an outer part providing an outer surface of the side-plate, the outer part defining an internal volume; and an inner part filling or substantially filling the internal volume defined by the outer part, the inner part being distinct from the outer part.

* * * * *